US012025037B2

(12) United States Patent
Raimondi et al.

(10) Patent No.: US 12,025,037 B2
(45) Date of Patent: Jul. 2, 2024

(54) BIDIRECTIONAL LATCH PIN ASSEMBLY, SWITCHABLE ROCKER ARM, AND VALVETRAIN ASSEMBLY

(71) Applicant: Eaton Intelligent Power Limited, Dublin (IE)

(72) Inventors: Emanuele Raimondi, Turin (IT); Nicola Andrisani, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/548,022

(22) PCT Filed: Mar. 7, 2022

(86) PCT No.: PCT/EP2022/025083
§ 371 (c)(1),
(2) Date: Aug. 25, 2023

(87) PCT Pub. No.: WO2022/184327
PCT Pub. Date: Sep. 9, 2022

(65) Prior Publication Data

US 2024/0133322 A1 Apr. 25, 2024

Related U.S. Application Data

(60) Provisional application No. 63/157,103, filed on Mar. 5, 2021.

(51) Int. Cl.
*F01L 1/18* (2006.01)
*F01L 1/46* (2006.01)
(Continued)

(52) U.S. Cl.
CPC ..... *F01L 1/185* (2013.01); *F01L 1/46* (2013.01); *F01L 13/0005* (2013.01);
(Continued)

(58) Field of Classification Search
CPC ... F01L 1/185; F01L 2001/186; F01L 1/2405; F01L 1/46; F01L 13/0005; F01L 2820/032
(Continued)

(56) References Cited

U.S. PATENT DOCUMENTS

2003/0111031 A1* 6/2003 Hendricksma ..... F01L 1/185 123/90.15
2018/0058275 A1 3/2018 Radulescu
(Continued)

FOREIGN PATENT DOCUMENTS

WO WO 2020240479 A1 12/2020

OTHER PUBLICATIONS

International Search Report and Written Opinion for International Application No. PCT/EP2022/025083, 10 pages, dated Jun. 15, 2022.

*Primary Examiner* — Jorge L Leon, Jr.
(74) *Attorney, Agent, or Firm* — Baker Botts L.L.P.

(57) ABSTRACT

A bidirectional latch pin assembly can comprise a housing portion comprising a latch port. A latch pin in the latch port can comprise a stepped nose extending from a body portion. The stepped nose can comprise a first step and a second step. A spring can be biased against a guide mounted in the latch port and the spring can be configured to bias the latch pin to a first position extending the first step out of the latch port. A first actuation assembly can be configured to move the latch pin to a second position extending the first step and the second step out of the latch port. A second actuation assembly can be configured to move the latch pin to a third position pulling the first step and the second step into the latch port. A switchable rocker arm and a valvetrain assembly can be formed therewith.

13 Claims, 6 Drawing Sheets

(51) Int. Cl.
*F01L 13/00* (2006.01)
*F01L 1/24* (2006.01)

(52) U.S. Cl.
CPC ..... *F01L 2001/186* (2013.01); *F01L 1/2405* (2013.01); *F01L 2820/032* (2013.01)

(58) Field of Classification Search
USPC ..... 123/90.16, 90.41, 90.43, 90.44, 90.46
See application file for complete search history.

(56) References Cited

U.S. PATENT DOCUMENTS

| | | | | |
|---|---|---|---|---|
| 2018/0363518 | A1* | 12/2018 | Raimondi | F01L 13/0036 |
| 2019/0120090 | A1* | 4/2019 | Andrisani | F01L 1/18 |
| 2020/0291826 | A1* | 9/2020 | Mandell | F01L 13/06 |

* cited by examiner

BIDIRECTIONAL LATCH PIN ASSEMBLY, SWITCHABLE ROCKER ARM, AND VALVETRAIN ASSEMBLY

PRIORITY

This application claims the benefit under 35 U.S.C. § 371 of International Patent Application No. PCT/EP2022/025083, filed 7 Mar. 2022, which claims the benefit under 35 U.S.C. § 119(e) of U.S. Provisional Patent Application No. 63/157,103, filed 5 Mar. 2021, which are incorporated herein by reference.

FIELD

This application provides a bidirectional latch pin assembly, switchable rocker arm therewith, and valvetrain assembly for actuating the bidirectional latch pin assembly. The bidirectional latch pin assembly can comprise a stepped latch pin configured to switch among three positions.

BACKGROUND

Rocker arms can comprise latch pins to switch lift profiles transferred to valves on a cylinder head. Such can also be called switching roller finger followers ("SRFFs"). While other mechanisms exist in the art, the ability to switch stably with a low part count in a tight package are impediments.

SUMMARY

The methods and devices disclosed herein overcome the above disadvantages and improves the art by way of a bidirectional latch pin assembly, switchable rocker arm therewith, and valvetrain assembly for actuating the bidirectional latch pin assembly. The bidirectional latch pin assembly can comprise a stepped latch pin configured to switch among three positions. A neutral position can be stably ensured with a low part count. So, too, the stable positioning of second and third latch pin positions can be assured.

A bidirectional latch pin assembly can comprise a housing portion comprising a latch port. A latch pin can be in the latch port. The latch pin can comprise a stepped nose extending from a body portion. The stepped nose can comprise a first step and a second step. A guide can be mounted in the latch port. A spring can be biased against the guide and can be configured to bias the latch pin to a first position extending the first step out of the latch port. A first actuation assembly can be configured to move the latch pin to a second position extending the first step and the second step out of the latch port. A second actuation assembly can be configured to move the latch pin to a third position pulling the first step and the second step into the latch port.

A switchable rocker arm can comprise a bidirectional latch pin assembly. An outer arm can be joined by the housing portion. An inner arm can be configured either to engage the latch pin in the first position or the second position or to move past the latch pin in the third position.

A valvetrain assembly can comprise the switchable rocker arm. A hydraulic pressure supply can be connected to the latch port to supply fluid actuation force to move the latch pin in a first direction. And, an actuator can be configured to supply mechanical actuation force to move the latch pin in a second direction.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Wherever possible, the same reference numbers will be used throughout the drawings to refer to the same or like parts.

Figure 1A:
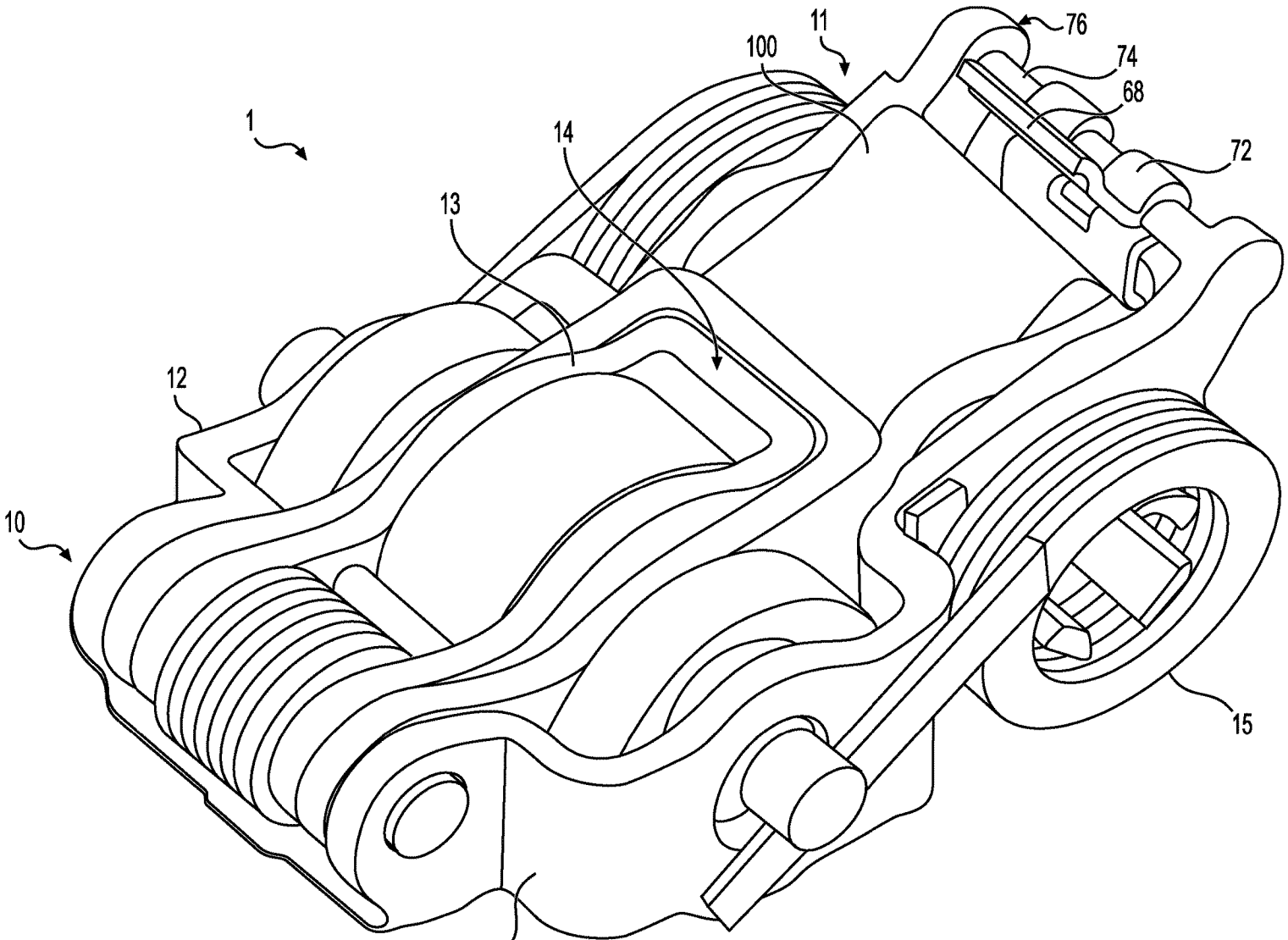
FIGS. 1A & 1B are non-exhaustive examples of switchable rocker arms compatible with the bidirectional latch pin assembly and valvetrain assemblies taught herein.
Figure 1B:
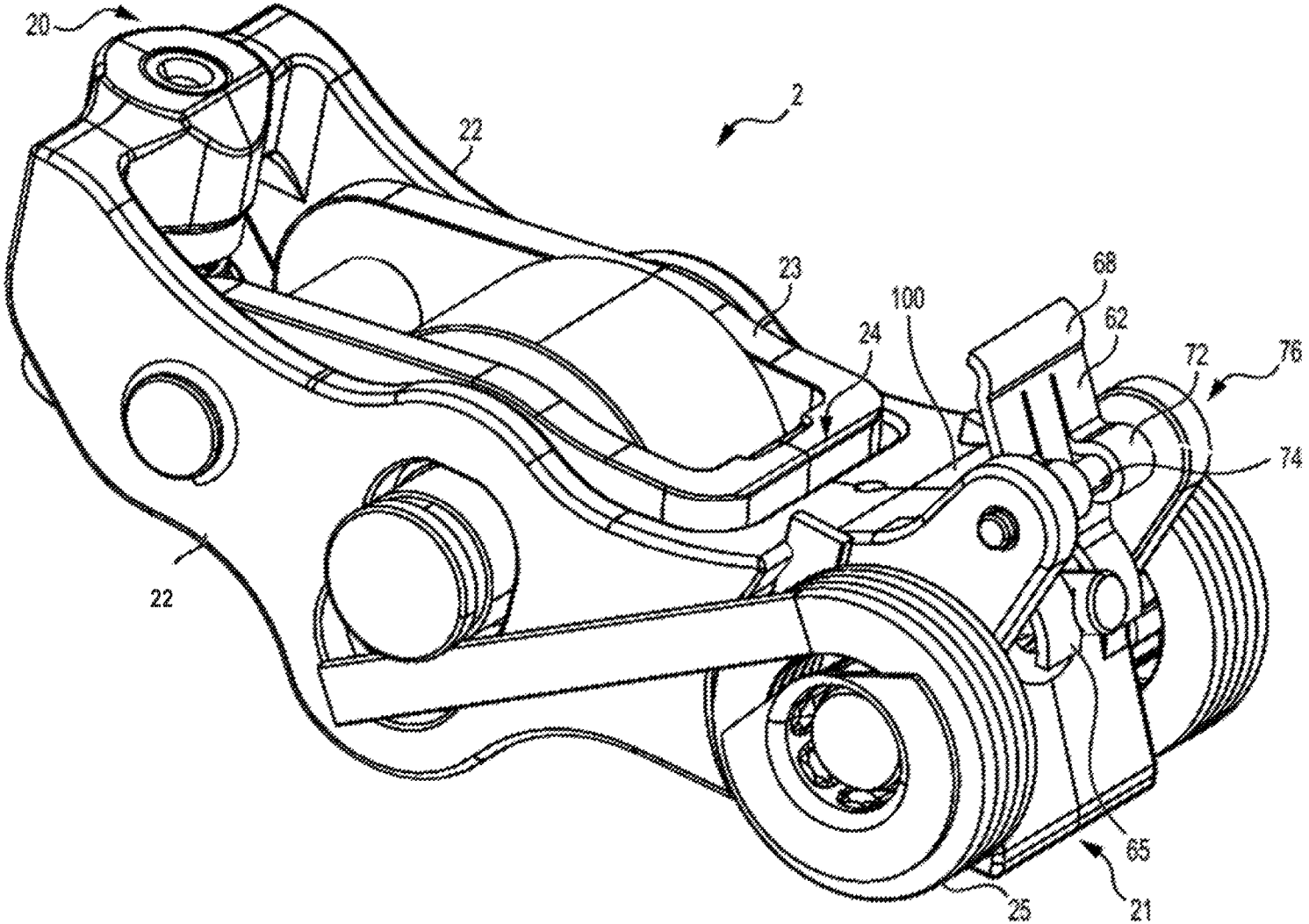
Figure 2A:
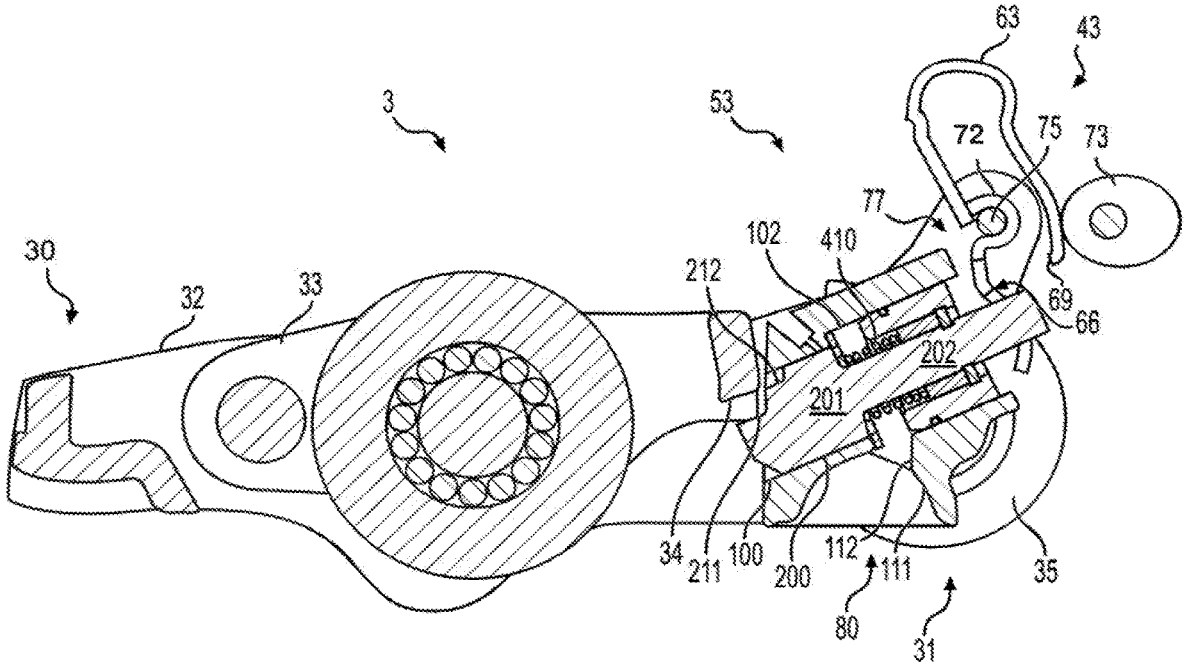
FIGS. 2A & 2B are cross-section views of a neutral or nominal position for a latch pin and alternative actuator arrangements.
Figure 2B:
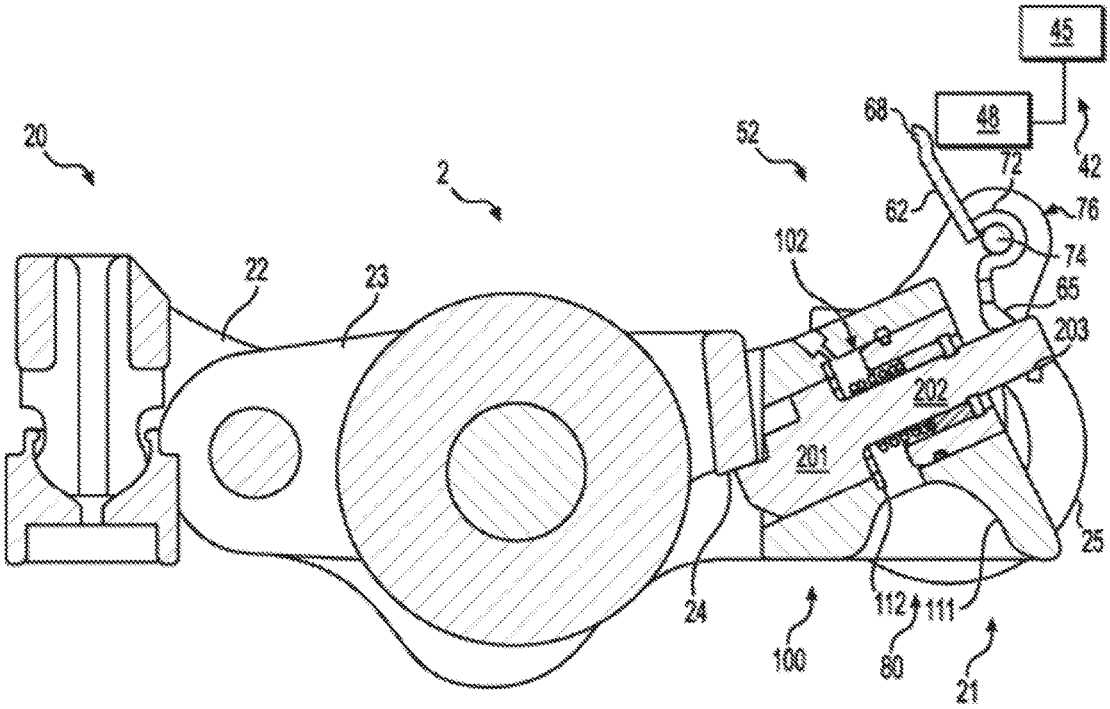
Figure 3:
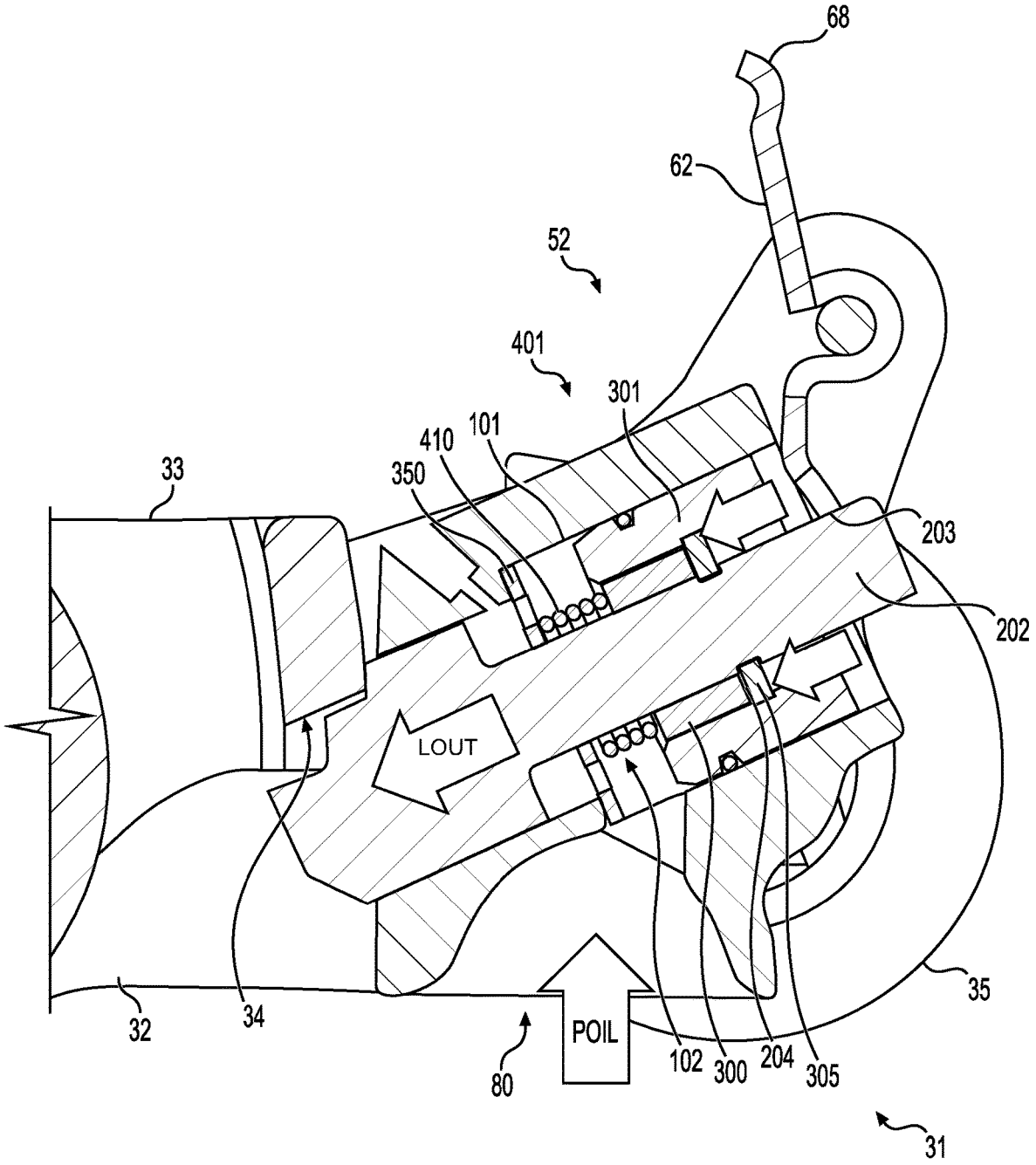
FIG. 3 shows an arrangement for extending the latch pin out of the latch port. Hydraulic control or electromechanical control can move the latch pin out.

An actuation system 41, 42, 43 for a switching roller finger follower ("SRFF"), also called a rocker arm 1, 2, 3, can be arranged as shown in FIGS. 2A-3. The switching roller finger follower can comprise a latch pin 200 and a combination of hydraulic actuation and electromechanical actuation. Many options exist for the electromechanical actuation system, such as those commonly owned and illustrated in U.S. Ser. No. 10/954,826, U.S. Ser. No. 11/028,736, U.S. Ser. No. 10/968,790, U.S. Ser. No. 11/248,501, U.S. Ser. No. 11/236,643, & US2021/0040868. A valve train 53 can comprise an actuation system 43 comprising a lever 63 such as the "R" shaped element of FIG. 2A. A controller such as an electronic control unit (ECU) or other onboard computer can control a motor or other device to rotate a camshaft with a cam 73 to press on the actuator end 69 of the lever 63. The "R" shaped element can flex and pull or push the pin end 66 and transfer actuation forces to the latch pin 200. Or, actuation system 41, 42 can comprise a controller 44, 45 such as an electronic control unit (ECU) or other onboard computer. An electric signal to an actuator 47, 48 can cause a plunger to push, or a spring or cam to rotate, or a mating lever to pivot, among other options, and thereby the actuation system 41, 42 pushes on the actuator end 68 of lever 62. Pin end 65 of lever 62 can be forked or otherwise shaped or anchored to lever mounting area 203 of latch pin 200 to push the latch pin 200 into or out of the latch port 101 of the housing portion 100. Levers 62, 63 are illustrated with a pivot body 72 encircling at least a part of a pivot pin 74, 75 forming a fulcrum at a pivot location 76, 77 of the housing portion 100. Levers 62, 63 can be a crimped or stamped sheet material shaped to at least partially encircle the pivot pin 74, 75. Or, a tab of material can be formed on the levers 62, 63, among other options.

A valvetrain 51, 52, 53 can comprise a latch pin 200 and a combination of hydraulic actuation and electromechanical actuation as shown. Actuation assemblies for the latch pin 200 can comprise a combination of hydraulic actuation system and electromechanical actuation system as shown. And, a spring 410, 420 can be positioned with the bidirectional latch pin assembly so that the latch pin 200 is configured to switch among three stable positions.

A switching roller finger follower or switchable rocker arm 1, 2, 3 can comprise a pivot end 11, 21, 31 and a valve end 10, 20, 30. The valve end can comprise a number of alternatives such as a valve pallet, a spigot, a capsule, among other options. A latch pin 200 can be installed in the pivot end 11, 21, 31. And, an actuation system for the latch pin 200 can comprise a hydraulic actuation system configured at least partially within the pivot end 11, 21, 31 and an electromechanical actuation system configured to act on the latch pin 200. The switchable rocker arm 1, 2, 3 can be installed in a valvetrain 51, 52, 53.

By the arrangement, the latch pin 200 can be configured to switch from a first position in a nominal or normal mode, to a second position extended from the first position, or to a third position retracted from the first position. The first, second and third positions can be switched among via control of first and second actuation assemblies.

The combination of the spring 410, 420 and the two actuation assemblies yields stable control for each of the three positions. The rocker arm 1, 2, 3 is light in weight for fast motion to actuate the associated valves. The rocker arm itself has a low part count, with efficient use of internal rocker arm space for the hydraulic and spring control for two positions. And, the weight of the lever 62, 63 for electromechanical actuation is not large nor is it transferred to the rocker arm 1, 2, 3 to cause inertia. So, merging the two actuation assemblies yields good results for the rocker arm 1, 2, 3 despite needing both a hydraulic circuit and an electro-mechanical circuit.

The order in which the switching occurs can be computer-controlled to be in any order that facilitates the operation of the valvetrain. That is, the designation of first, second, and third is for the benefit of antecedence within the document and is not meant to limit the commercial implementation to that order. Similarly, the designation of first and second actuation assemblies is not meant to limit the operation of the assemblies to that order. So, the third position can be achieved at key-on, when it is electrically controlled via electromechanical actuation, and the second position can be achieved during operation at or after idle when the hydraulic actuation is primed. The first position can be achieved at any time as a nominal mode because it is biased by spring 410, 420 that does not need computer, electrical, or hydraulic control.

So, since the hydraulic actuation system can move the latch pin 200 to either of the second position or the third position and the electromechanical actuation system can likewise move the latch pin 200 to either of the second position or the third position, the designation of the first and second actuation assemblies in the claims is meant to capture the presence of one of each of the hydraulic actuation system and the electromechanical actuation system. But, the order in which these actuation systems are used in practice is not limited to the ordinal designations.

The electromechanical actuation system can comprise any one of the actuation systems 41, 42, 43 configured to act on levers 62, 63, among others known in the art. The hydraulic actuation system can be configured with various known components, such as hydraulic lash adjuster or pivot end spigot, oil control valve (OCV), pump, pump controller, among other expedients. Many options exist for the hydraulic actuation system, such as those commonly owned and illustrated in U.S. Pat. No. 7,318,402, US2018/0306072, U.S. Ser. No. 11/028,736, among others. The hydraulic actuation assembly 80 can comprise expedients in the pivot end 11, 21, 31 such as a pivot socket 111 to receive a hydraulic control fluid. A pressure feed 112 can direct hydraulic control fluid from the pivot socket 111 to pressure compartment 102 of the latch port 101. A bleed port 103 can be optional. The spigot or lash adjuster supplying the hydraulic control fluid can be coupled to the pivot socket 111.

The latch pin 200 can be configured biased in a nominal or normal mode in a centered position for a primary valve lift mode. Such can be seen in FIGS. 2A & 2B. When the actuation system acts on the latch pin 200, the latch pin 200 moves to a second stable position configured in a secondary valve lift mode. This can be seen in FIG. 3. Either hydraulic control fluid can be supplied as schematically represented by the arrow POI L or the lever 62 can be acted on so that the latch pin 200 moves in the direction of extending latch arrow LOUT. And, when the actuation system acts on the latch pin 200 to move it to a third stable position, the rocker arm 1, 2, 3 can be configured in a third valve lift mode. This can be seen in FIGS. 4A-4C.

Figure 4A:
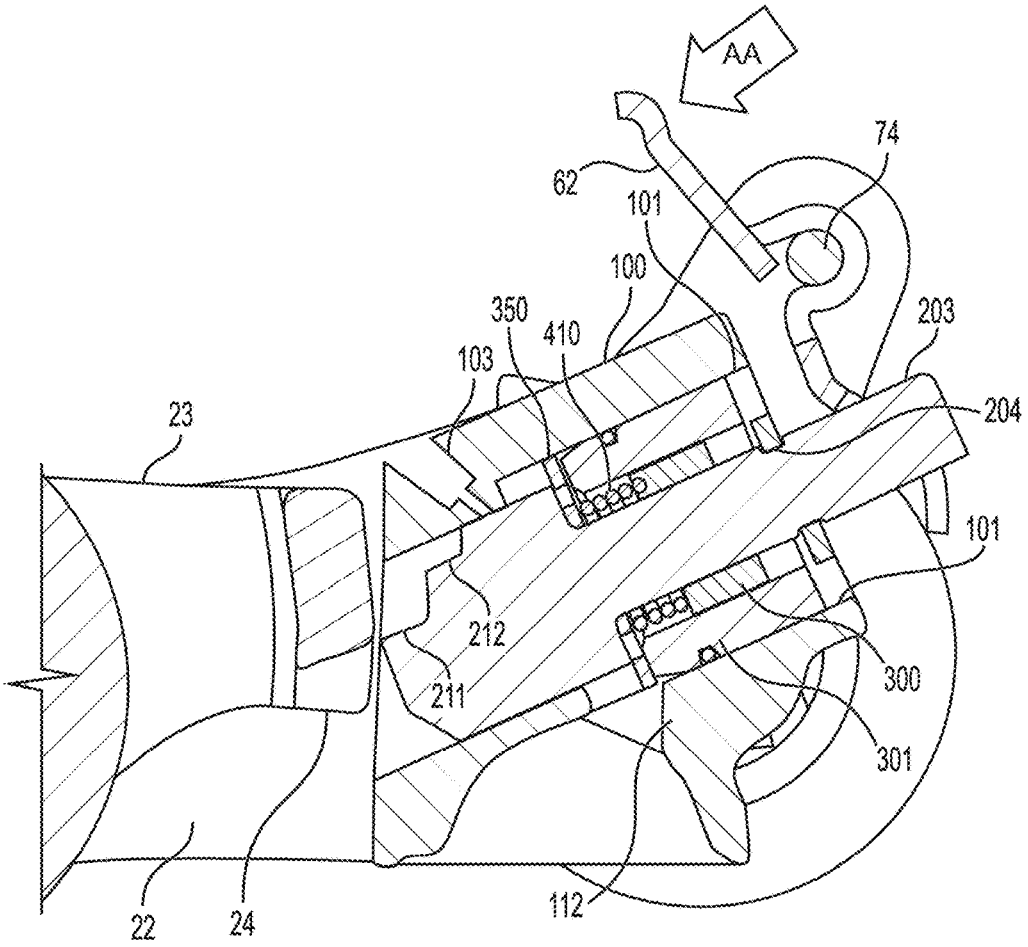
FIGS. 4A & 4C show alternative actuator arrangements to move the first step and the second step into the latch port. The lever on the latch pin can be actuated to pull the latch pin into the latch port or hydraulic control can be applied to push the latch pin into the latch port.
Figure 4B:
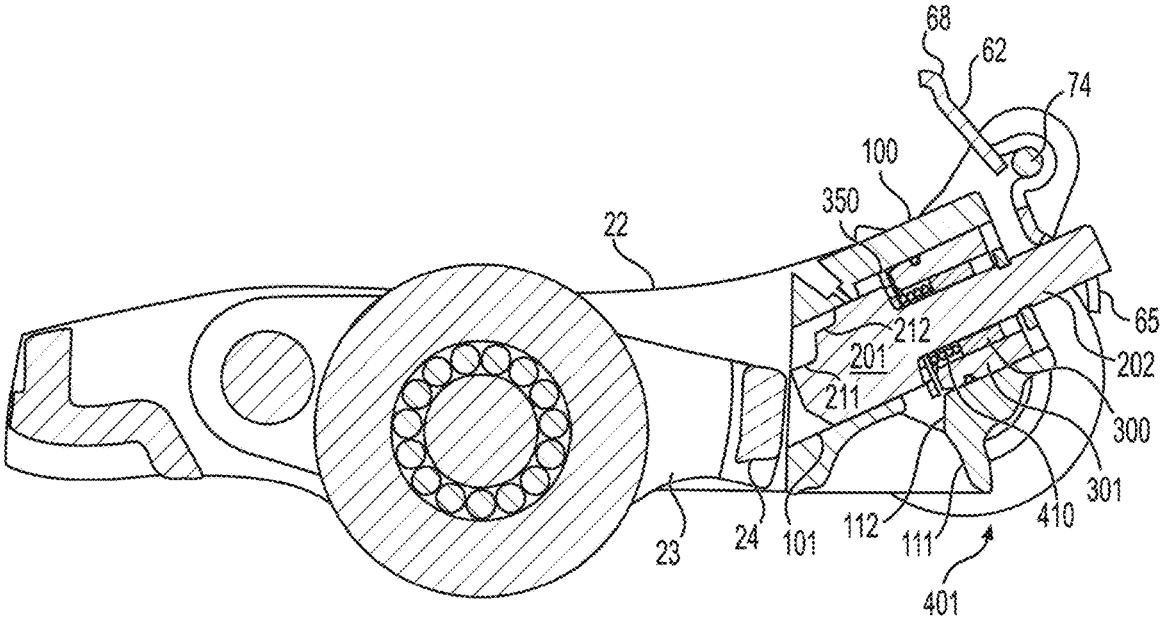
FIG. 4B shows an inner arm of the switchable rocker arm pivoting past the bidirectional latch pin assembly.
Figure 4C:
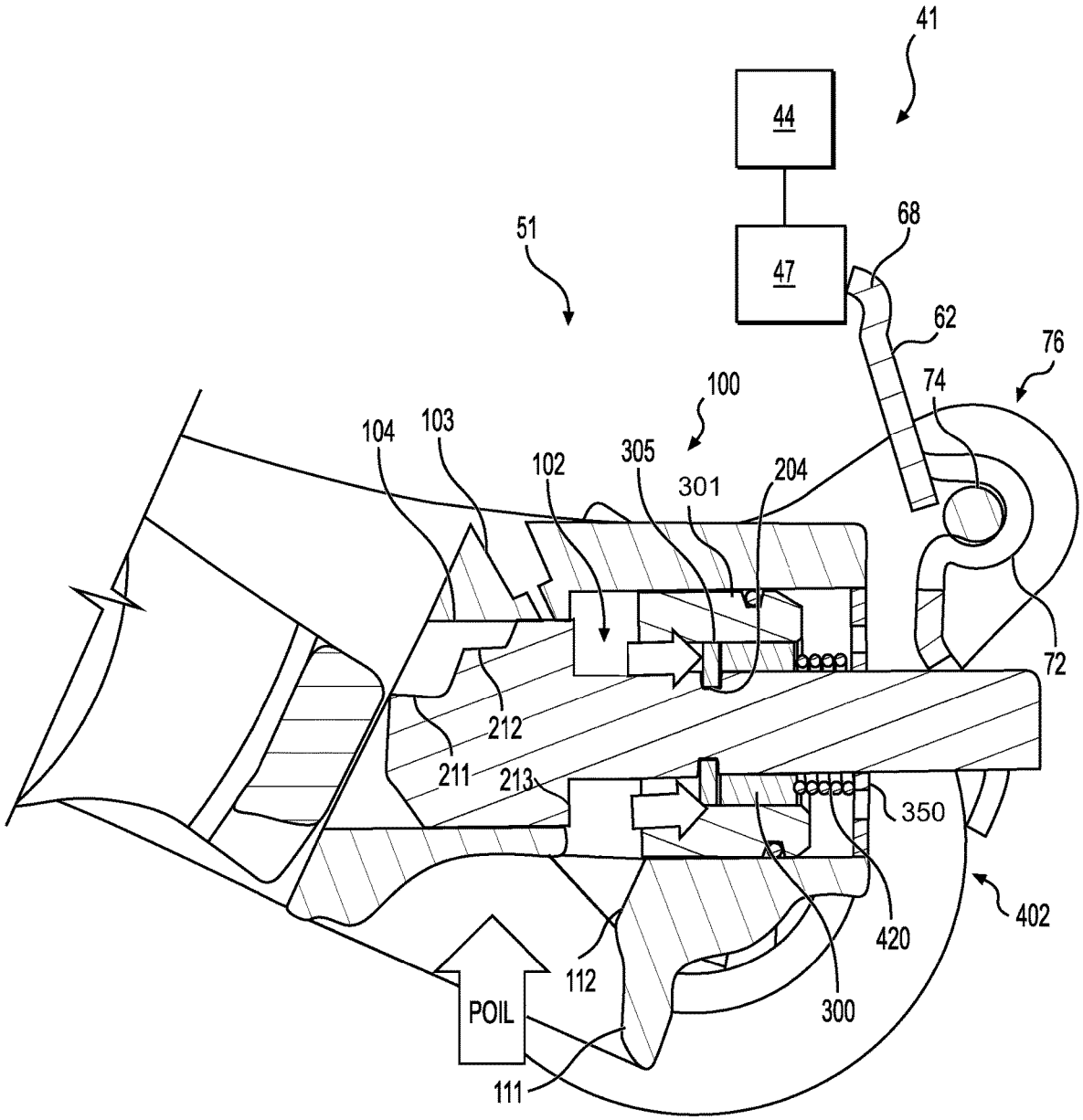

The first and second actuation systems can act in opposition to move the latch pin 200 so that the latch pin 200 moves via an electromechanical pressure to configure the switching roller finger follower in a variable valve lift mode. And, the other of the first and second actuation system can act on the latch pin 200 via an oil or other hydraulic pressure to configure the switching roller finger follower (rocker arm 1, 2, 3) in another variable valve lift mode. One of the variable valve lift modes can be a different lift height than nominal with the other variable valve lift mode can be a deactivated or zero lift height, for example. The third position can be seen in FIGS. 4A-4C. In FIG. 4A, an actuation force on lever 62, schematically represented by actuation arrow AA can pull the latch pin 200 back and withdraw stepped nose 201 into latch port 101. When an overhead cam in the valvetrain acts on the inner arm 23, the latch ledge 24 is not impeded and it swings past the latch pin 200 in FIG. 4B. In FIG. 4C, either actuation system 41 can be controlled via controller 44 so that actuator 47 pushes on lever 62 or hydraulic control fluid can be supplied as schematically represented by the arrow POIL. In either actuation scenario, the latch pin 200 is withdrawn into the latch port 101.

The latch pin 200 facilitating selection of three different latching positions is disclosed in a switching roller finger follower (SRFF) (rocker arm 1, 2, 3). Multiple valve lift modes can be implemented enabling variable valve actuation (VVA) such as early or late valve opening or closing, internal exhaust gas recirculation, braking, among others. Some examples include CDA, LIVC, EIVC, EEVO, LEVO, iEGR, EB, etc. Example SRFFs are shown but other rocker arms comprising a movable latch can benefit via the teachings herein.

The latch pin 200 can have hybrid actuation, such as a combination of hydraulic and electro-mechanical actuation. Or, a singular actuator can be provided, such as an electromechanical assembly configured selectively to push and pull the latch pin 200.

Instead of a two-position latch pin having a binary latched/unlatched position, a latch pin 200 is herein disclosed to offer three positions. The latch pin 200 position can be controlled by an external actuator such as an electromagnetic actuation, or hydraulic actuator or combination thereof. As an example, an oil control valve (OCV) can be controlled via a dual feed hydraulic lash adjuster (HLA). Such hydraulic control could be combined with an electromechanical actuator that can control at least one of the positions of the latch pin 200 or that can control one direction of the motion of the latch pin 200.

In a steady condition, where no external actuation is applied, the latch pin 200 can be kept in a middle position by a spring 410, 420. The spring 410, 420 can be configured as a return spring configured to position the latch pin 200 in the first position as a default position. When force from the hydraulic actuation system and the electromechanical actuation system is absent, the spring 410, 420 positions the latch pin 200.

Spring 410, 420 can push on a spring seat 350 such as a washer or circlip seated in the latch port 101. A spring guide such as a lip or post can be included on the spring seat 350. Spring 410, 420 can also push on a guide 300 assembled on the body portion 202 of the latch pin 200. Guide 300 can be a bushing or washer or other select-fit item that can control the force of the spring 410, 420 between the spring seat 350 and the guide 300. If guide 300 is not press fit or crimped in place, a clip 305 can be used to lock the configuration of the body portion 202 relative to the spring seat 350. A clip groove 204 can be included on the body portion 202 to receive the clip 305.

Activation via an OCV can cause a rise of oil pressure in pressure compartment 102. This translates the latch pin 200 either toward (FIG. 3) or away from (FIG. 4C) the inner arm 13, 23, 33. The return spring 410, 420 is compressed by the guide 300 that is translating together with the latch pin 200. When oil pressure is alleviated and drops (OCV off), the latch pin 200 will return to the first position (nominal). Actuation can also be achieved through an external actuator acting on external lever 62, 63. In the examples, latch pin 200 moves to compress the spring 410, 420 acting on the spring seat 350.

Latch pin 200 can comprise a stepped nose 201. An outer portion of the stepped nose 201 can be guided by the inner side of latch port 101. Latch port 101 can be stepped, also, for oil pressure control or for guiding edges, or both. Stepped nose 201 can comprise a first step 211 and a second step 212 sized to impart different lift profiles to the rocker arm 1, 2, 3. For example, when latch ledge 14, 24, 34 presses on first step 211, one lift profile can be transferred through the valve end 10, 20, 30. But, when the second step 212 interfaces with latch ledge 14, 24, 34, a different lift profile can be transferred through the valve end 10, 20, 30.

An end surface 213 of the stepped nose 201 can seal against the pressure compartment 102 directly (FIG. 4C) or can abut a travel stop like the spring seat 350 (FIGS. 2A & 2B). Or, in FIG. 3, the spring seat 350 can be formed with pass-through holes for hydraulic fluid to act on the end surface. Body portion 202 can extend from the stepped nose 201. Body portion 202 can be guided by the spring seat 350, the guide 300, and optionally also the clip 305.

Body portion 202 can move within a sleeve 301 fitted in the latch port 101. Sleeve 301 allows a drop-in assembly of the spring seat 350, spring 410, 420, guide 300. Sleeve 301 can be fitted in the latch port 101 with or without an o-ring, washer, or circlip. A press-fit, slip fit, or crush fit are options for sleeve 301. Sleeve 301 can be optionally included to provide diameter changes.

A bidirectional latch pin assembly can comprise a housing portion 100 comprising a latch port 101. A latch pin 200 in the latch port 101 can comprise a stepped nose 201 extending from a body portion 202. The stepped nose 201 can comprise a first step 211 and a second step 212. A guide 300 can be mounted in the latch port 101. As an option, the guide 300 can be seated in a sleeve 301. A spring 410, 420 can be biased against the guide 300 and configured to bias the latch pin 200 to a first position extending the first step 211 out of the latch port 101.

A first actuation assembly can be configured to move the latch pin 200 to a second position extending the first step 211 and the second step 212 out of the latch port 101. A second actuation assembly can be configured to move the latch pin 200 to a third position pulling the first step 211 and the second step 212 into the latch port 101.

The first actuation assembly or the second actuation assembly can comprise a pressure compartment 102 between the stepped nose 201 and the guide 300. A pressure feed 112 can be connected to the pressure compartment 201.

The housing portion can be configured to seat a hydraulic lash adjuster in a pivot socket 111. The pressure feed 112 can be connected to receive hydraulic pressure from the hydraulic lash adjuster as by being fluidly connected to the pivot socket 111.

The first actuation assembly or the second actuation assembly can comprise an actuation lever 62, 63 connected to the body portion 202. The housing portion 100 can comprise a pivot location 76, 77. The actuation lever 62, 63 can be connected to pivot at the pivot location 76, 77.

The first actuation assembly can comprise a pressure compartment 102 between the stepped nose 201 and the guide 300. A pressure feed 112 can be connected to the pressure compartment 102. The second actuation assembly can comprise an actuation lever 62, 63 connected to the body portion 202.

Or, the first actuation assembly can comprise an actuation lever 62, 63 connected to the body portion 202. And, the second actuation assembly can comprise a pressure compartment 102 between the stepped nose 201 and the guide 300 and a pressure feed 112 connected to the pressure compartment 102.

A spring seat 350 can be in the latch port 101. The spring seat 350 can seat the spring 410, 420 to press on the guide 300. A sleeve 301 can be in the latch port 101. The guide 300 can be slidable in the sleeve 301. The spring 420 can be is seated in the sleeve 301 to press on the guide 300. A clip 305 can be affixed to the body portion 202 to position the guide 300.

A switchable rocker arm 1, 2, 3 can comprise the bidirectional latch pin assembly. Outer arms 12, 22, 32 can be joined by the housing portion 100. And, inner arms 13, 23, 33 can be configured to engage the latch pin 200 in the first position or the second position or to move past the latch pin 200 in the third position.

A valvetrain assembly 51, 52, 53 can comprise the switchable rocker arm 1, 2, 3. Valvetrain assembly 51, 52, 53 can comprise a hydraulic pressure supply connected to the latch port 101 to supply fluid actuation force to move the latch pin 200 in a first direction. And, an actuation system 41, 42, 43 can be configured to supply mechanical actuation force to move the latch pin 200 in a second direction.

Other implementations will be apparent to those skilled in the art from consideration of the specification and practice of the examples disclosed herein.

What is claimed is:

1. A bidirectional latch pin assembly, comprising:

a housing portion including a latch port;

a latch pin arranged in the latch port, the latch pin including a stepped nose extending from a body portion, the stepped nose including a first step and a second step;

a guide mounted in the latch port;

a spring pressed against the guide, the spring configured to bias the latch pin to a first position in which the first step is extended out of the latch port and the second step remains in the latch port;

a first actuation assembly configured to move the latch pin to a second position in which the first step and the second step are extended out of the latch port; and a second actuation assembly configured to move the latch pin to a third position in which the first step and the second step are retracted into the latch port.

2. The bidirectional latch pin assembly of claim 1, wherein at least one of the first actuation assembly or the second actuation assembly includes:

a pressure compartment arranged between the stepped nose and the guide; and a pressure feed connected to the pressure compartment so as to supply a hydraulic control fluid to the pressure compartment.

3. The bidirectional latch pin assembly of claim 2, wherein the housing portion further includes a pivot socket configured to receive a spigot or hydraulic lash adjuster, and wherein the hydraulic control fluid is supplied to the pressure feed via the pivot socket.

4. The bidirectional latch pin assembly of claim 1, wherein at least one of the first actuation assembly or the second actuation assembly includes an actuation lever connected to the body portion.

5. The bidirectional latch pin assembly of claim 4, wherein the housing portion further includes a pivot location, and wherein the actuation lever is configured to pivot at the pivot location.

6. The bidirectional latch pin assembly of claim 1, wherein:

the first actuation assembly includes:

a pressure compartment arranged between the stepped nose and the guide; and a pressure feed connected to the pressure compartment; and the second actuation assembly includes an actuation lever connected to the body portion.

7. The bidirectional latch pin assembly of claim 1, wherein:

the first actuation assembly includes an actuation lever connected to the body portion; and the second actuation assembly includes:

a pressure compartment arranged between the stepped nose and the guide; and a pressure feed connected to the pressure compartment.

8. The bidirectional latch pin assembly of claim 1, further comprising a spring seat arranged in the latch port, the spring engaging the spring seat so as to press against the guide.

9. The bidirectional latch pin assembly of claim 1, further comprising a sleeve arranged in the latch port, the guide configured to slide in the sleeve.

10. The bidirectional latch pin assembly of claim 9, wherein the spring is seated in the sleeve so as to press against the guide.

11. The bidirectional latch pin assembly of claim 10, further comprising a clip affixed to the body portion so as to position the guide.

12. A switchable rocker arm comprising:

a bidirectional latch pin assembly including:

a housing portion including a latch port, a latch pin arranged in the latch port, the latch pin including a stepped nose extending from a body portion, the stepped nose including a first step and a second step, a guide mounted in the latch port, a spring pressed against the guide, the spring configured to bias the latch pin to a first position in which the first step is extended out of the latch port and the second step remains in the latch port, a first actuation assembly configured to move the latch pin to a second position in which the first step and the second step are extended out of the latch port, and a second actuation assembly configured to move the latch pin to a third position in which the first step and the second step are retracted into the latch port;

an outer arm connected to the housing portion; and an inner arm configured to:

engage the first step when the latch pin is in the first position, or engage the second step when the latch pin is in the second position, or move past the first step and the second step when the latch pin is in the third position.

13. A valvetrain assembly comprising:

a switchable rocker arm including:

a bidirectional latch pin assembly including:

a housing portion including a latch port, a latch pin arranged in the latch port, the latch pin including a stepped nose extending from a body portion, the stepped nose including a first step and a second step, a guide mounted in the latch port, a spring pressed against the guide the spring configured to bias the latch pin to a first position in which the first step is extended out of the latch port and the second step remains in the latch port, a first actuation assembly configured to move the latch pin to a second position in which the first step and the second step are extended out of the latch port, and a second actuation assembly configured to move the latch pin to a third position in which the first step and the second step are retracted into the latch port;

an outer arm joined by connected to the housing portion;

an inner arm configured to:

engage the first step when the latch pin is in the first position, or engage the second step when the latch pin is in the second position, or move past the first step and the second step when the latch pin is in the third position;

a first actuation assembly connected to the latch port, the first actuation assembly configured to supply a hydraulic control fluid to the latch port so as to move the latch pin in a first direction; and a second actuation system configured to supply a mechanical actuation force to the body portion so as to move the latch pin in a second direction.

* * * * *